US009487896B2

(12) United States Patent
Schwarzberger et al.

(10) Patent No.: US 9,487,896 B2
(45) Date of Patent: Nov. 8, 2016

(54) QUILTING BRAKE

(71) Applicant: ABM International, Inc., The Woodlands, TX (US)

(72) Inventors: Neal A. Schwarzberger, The Woodlands, TX (US); Joseph Podolski, The Woodlands, TX (US)

(73) Assignee: ABM International, Inc., The Woodlands, TX (US)

( * ) Notice: Subject to any disclaimer, the term of this patent is extended or adjusted under 35 U.S.C. 154(b) by 44 days.

(21) Appl. No.: 14/618,723

(22) Filed: Feb. 10, 2015

(65) Prior Publication Data

US 2016/0230322 A1 Aug. 11, 2016

(51) Int. Cl.

| | |
|---|---|
| ***G06F 7/66*** | (2006.01) |
| ***D05C 5/00*** | (2006.01) |
| ***D05B 11/00*** | (2006.01) |
| ***D05B 19/02*** | (2006.01) |

(52) U.S. Cl.

CPC ..... *D05C 5/00* (2013.01); *D05B 11/00* (2013.01); *D05B 19/02* (2013.01)

(58) Field of Classification Search

CPC ..... D05B 11/00; D05B 19/02; D05C 5/00

USPC ..... 112/117–119

See application file for complete search history.

(56) References Cited

U.S. PATENT DOCUMENTS

| | | | | |
|---|---|---|---|---|
| 5,711,236 | A * | 1/1998 | Badger | D05B 11/00 112/117 |
| 7,207,281 | B1 * | 4/2007 | Kasa | D05B 11/00 112/117 |
| 2004/0255835 | A1 * | 12/2004 | Watts | D05B 11/00 112/118 |
| 2005/0016428 | A1 * | 1/2005 | Koerner | D05B 19/14 112/117 |
| 2005/0045083 | A1 * | 3/2005 | Canan | D05B 11/00 112/117 |
| 2009/0272304 | A1 * | 11/2009 | Watts | D05B 11/00 112/118 |
| 2011/0203506 | A1 * | 8/2011 | Price | D05C 15/26 112/475.08 |
| 2014/0190047 | A1 * | 7/2014 | McCoy | D05B 11/00 38/102.91 |

* cited by examiner

*Primary Examiner* — Nathan Durham

(74) *Attorney, Agent, or Firm* — Timothy W. Menasco, Esq.; Harter Secrest & Emery LLP

(57) ABSTRACT

Presented are a method, apparatus, and computer-readable medium for braking. The apparatus includes a plurality of rails, the plurality of rails comprising an x-axis rail and a y-axis rail, and a sewing head, the sewing head moveable along the plurality of rails. The apparatus further includes a first brake, the first brake affixed to the sewing head relative to the x-axis rail and able to selectively engage the x-axis rail, the first brake operable between an open position and a closed position, the open position allowing movement of the sewing head along the x-axis rail, the closed position substantially preventing movement of the sewing head along the x-axis rail. The apparatus further includes a second brake, the second brake affixed to the sewing head relative to the y-axis rail and able to selectively engage the y-axis rail.

20 Claims, 6 Drawing Sheets

Figure 1:
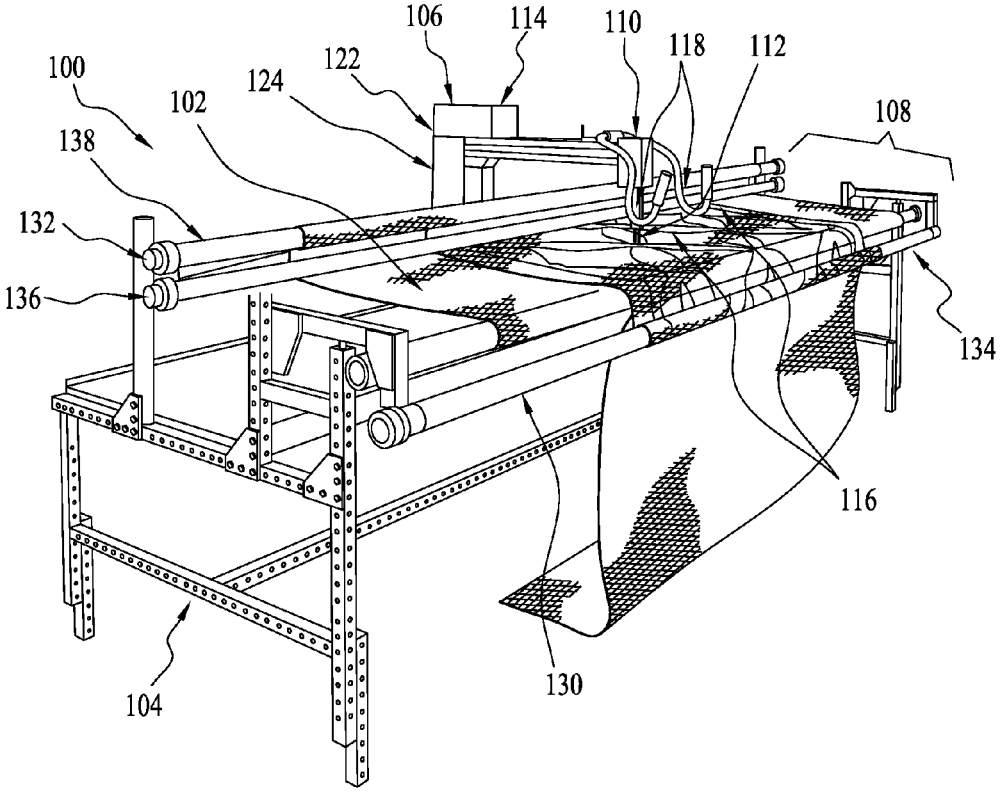

502: moving a sewing head in a first coordinate direction along a first coordinate rail and a second coordinate direction along a second coordinate rail, the first coordinate direction and the second coordinate direction being perpendicular to one another; and braking, by a first brake and a second brake, a movement of the sewing head, the first brake affixed to the sewing head relative to the first coordinate rail and able to selectively engage the first coordinate rail, the first brake operable between an open position and a closed position, the open position allowing movement of the sewing head along the first coordinate rail, the closed position substantially preventing movement of the sewing head along the first coordinate rail, the second brake affixed to the sewing head relative to the second coordinate rail and able to selectively engage the second coordinate rail, the second brake operable between an open position and a closed position, the open position allowing movement of the sewing head along the second coordinate rail, the closed position substantially preventing movement of the sewing head along the second coordinate rail.

↓

504: wherein the first brake further comprises a first lock, the first lock operable between a locked position and an unlocked position, the locked position maintaining the first brake in a closed position, and wherein the second brake further comprises a second lock, the second lock operable between a locked position and an unlocked position, the locked position maintaining the second brake in the close position

↓

506: wherein the first lock comprises a manual lever, and wherein the second lock comprises a manual lever

↓

508: wherein the sewing head further comprises a first handle and a second handle, the first handle comprising a first lever and a first connector, the first connector coupled to the first brake, the second handle comprising a second lever and a second connector, the second connector coupled to the second brake, the first handle and the second handle coupled to the sewing head and able to assist movement of the sewing head along the first coordinate rail and the second coordinate rail, the first lever and the second lever moveable between an open position and a clamping position, the open position of the first lever through the first connector corresponds to the open position of the first brake, the clamping position of the first lever through the first connector corresponds to the closed position of the first brake, the open position of the second lever through the second connector corresponds to the open position of the second brake, the clamping position of the second lever through the second connector corresponds to the closed position of the second brake

↓

510: wherein the first handle further comprises a first handle lock for locking the first lever in the clamped position, and the second handle further comprises a second handle lock for locking the second lever in the clamped position

↓

512: wherein the first coordinate rail and the second coordinate rail includes a flange

FIG. 5

QUILTING BRAKE

BACKGROUND OF THE INVENTION

1. Field of the Invention

The present disclosure relates to a method, apparatus, and computer-readable medium for quilting. The present disclosure more specifically relates to a method, apparatus, and computer-readable medium for a braking system in a quilting apparatus.

2. Description of Related Art

Machine quilting is quilting made through the use of a sewing machine to stitch rows or patterns using select techniques to stitch through layers of fabric and batting in the manner of old-style hand-quilting.

Free motion quilting is a process used to stitch the layers of a quilt together. Longarm quilting involves placing the layers to be quilted on a special frame. The frame has spindles on which the layers are rolled, keeping these layers together without the need for tacking or pinning. These frames are used with a sewing head mounted on a moveable platform. The platform rides along tracks so that the sewing head can move across the layers on the frame.

In all of the free motion quilting configurations the user of the quilting machine determines when and where to stop the movement of the sewing head of the quilting machine and then to move the sewing head of the quilting machine in a different direction.

BRIEF SUMMARY OF THE INVENTION

In view of the foregoing, it is an object of the present disclosure to provide a method, apparatus, and computer-readable medium for quilting.

A first exemplary embodiment of the present disclosure provides an apparatus for quilting. The apparatus includes a plurality of rails, the plurality of rails comprising an x-axis rail and a y-axis rail, and a sewing head, the sewing head moveable along the plurality of rails. The apparatus further includes a first brake, the first brake affixed to the sewing head relative to the x-axis rail and able to selectively engage to the x-axis rail, the first brake operable between an open position and a closed position, the open position allowing movement of the sewing head along the x-axis rail, the closed position substantially preventing movement of the sewing head along the x-axis rail. The apparatus further still includes a second brake, the second brake affixed to the sewing head relative to the y-axis rail and able to selectively engage to the y-axis rail, the second brake operable between an open position and a closed position, the open position allowing movement of the sewing head along the y-axis rail, the closed position substantially preventing movement of the sewing head along the y-axis rail.

A second exemplary embodiment of the present disclosure provides a method for quilting. The method includes moving a sewing head in a first coordinate direction along a first coordinate rail and a second coordinate direction along a second coordinate rail, the first coordinate direction and the second coordinate direction being perpendicular to one another. The method further includes braking, by a first brake and a second brake, a movement of the sewing head, the first brake affixed to the sewing head relative to the first coordinate rail and able to selectively engage to the first coordinate rail, the first brake operable between an open position and a closed position, the open position allowing movement of the sewing head along the first coordinate rail, the closed position substantially preventing movement of the sewing head along the first coordinate rail, the second brake affixed to the sewing head relative to the second coordinate rail and able to selectively engage to the second coordinate rail, the second brake operable between an open position and a closed position, the open position allowing movement of the sewing head along the second coordinate rail, the closed position substantially preventing movement of the sewing head along the second coordinate rail.

A third exemplary embodiment of the present disclosure provides a non-transitory computer-readable medium including computer program instructions which when executed on a processor of an apparatus causes the apparatus to at least move a sewing head in a first coordinate direction along a first coordinate rail and a second coordinate direction along a second coordinate rail, the first coordinate direction and the second coordinate direction being perpendicular to one another. The computer-readable medium including computer program instructions and the processor further cause the apparatus to at least brake, by a first brake and a second brake, a movement of the sewing head, the first brake affixed to the sewing head relative to the first coordinate rail and able to selectively engage to the first coordinate rail, the first brake operable between an open position and a closed position, the open position allowing movement of the sewing head along the first coordinate rail, the closed position substantially preventing movement of the sewing head along the first coordinate rail, the second brake affixed to the sewing head relative to the second coordinate rail and able to selectively engage to the second coordinate rail, the second brake operable between an open position and a closed position, the open position allowing movement of the sewing head along the second coordinate rail, the closed position substantially preventing movement of the sewing head along the second coordinate rail.

The following will describe embodiments of the present disclosure, but it should be appreciated that the present disclosure is not limited to the described embodiments and various modifications of the invention are possible without departing from the basic principle. The scope of the present disclosure is therefore to be determined solely by the appended claims.

BRIEF DESCRIPTION OF THE SEVERAL VIEWS OF THE DRAWING(S)

FIG. 1 presents a perspective view of an exemplary quilting machine suitable for use in practicing exemplary embodiments of this disclosure.

Figure 2:
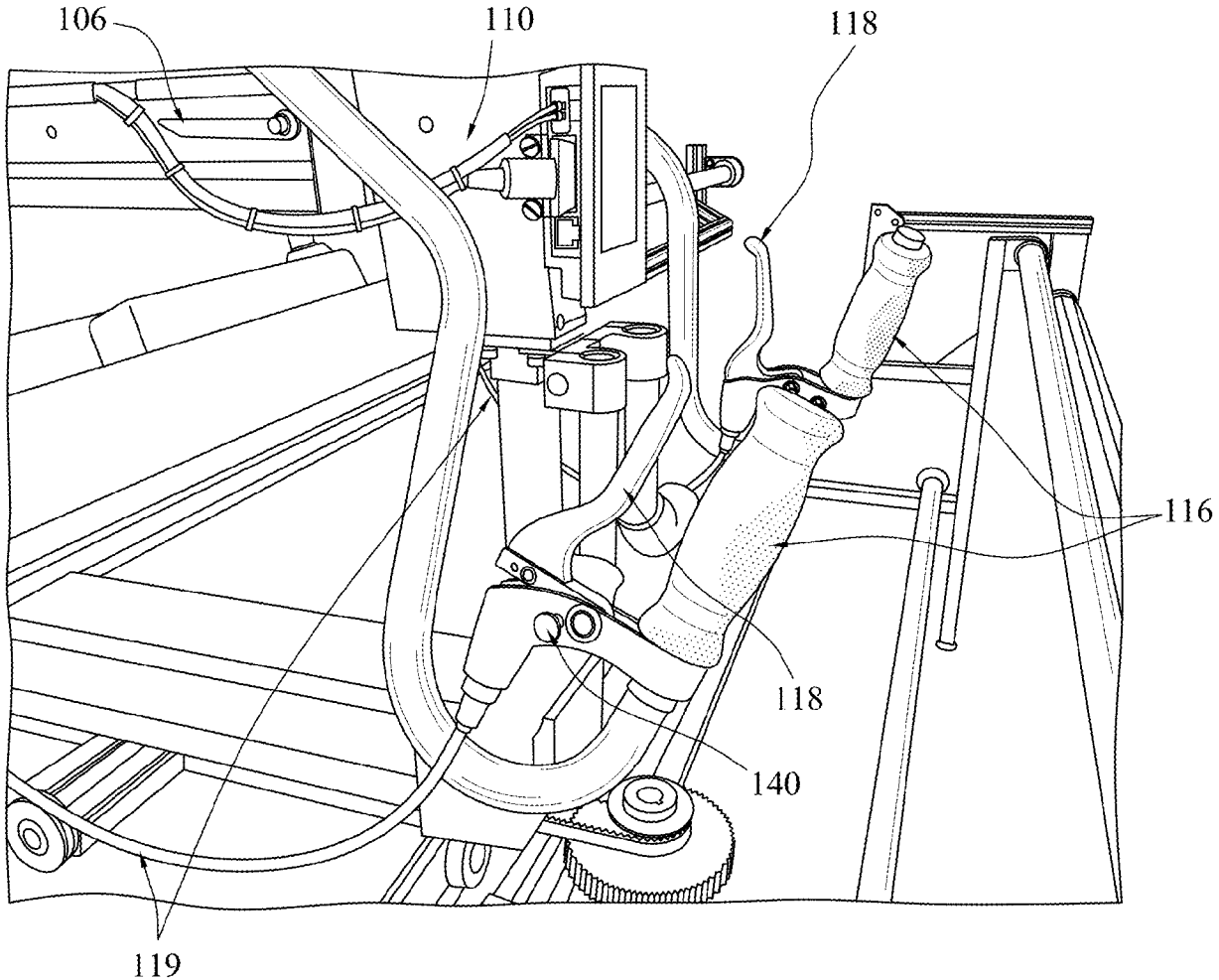

FIG. 2 presents a perspective view of an exemplary brake system of a quilting machine suitable for use in practicing exemplary embodiments of this disclosure.

Figure 3:
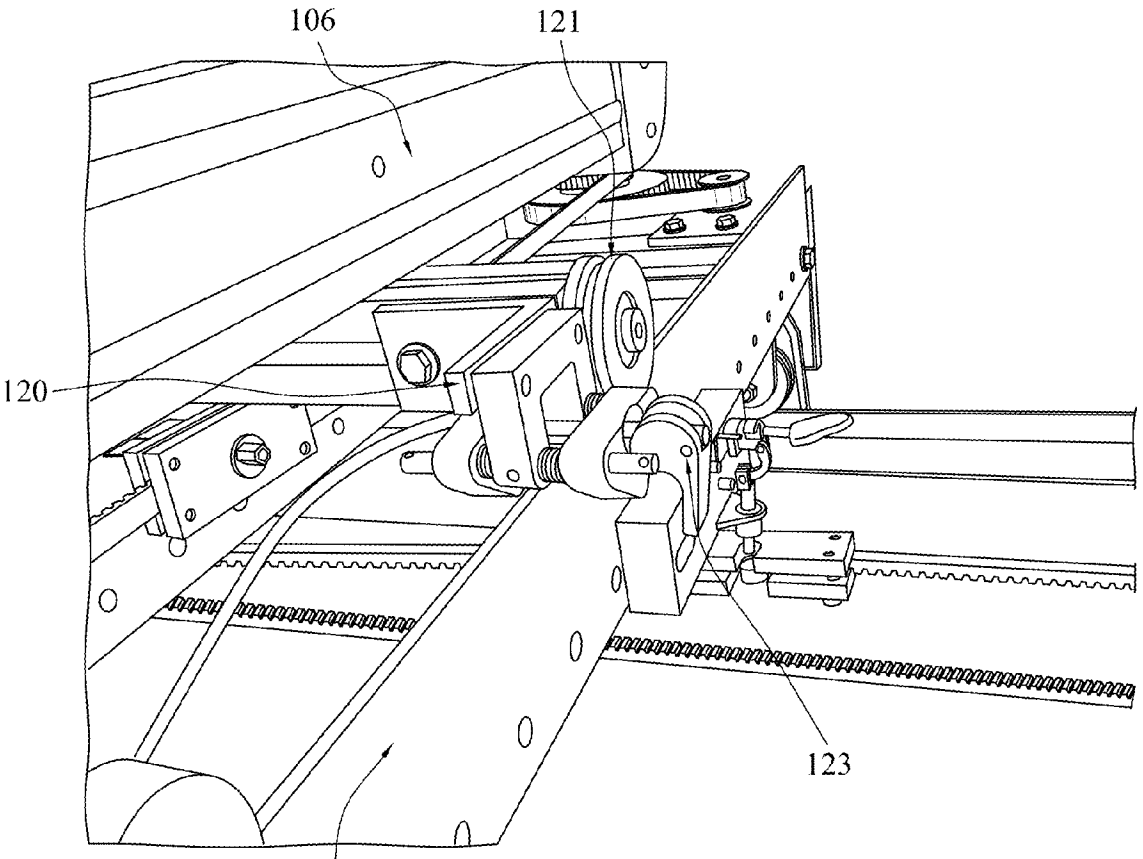

FIG. 3 presents a close up view of a portion of an exemplary brake system of a quilting machine suitable for use in practicing exemplary embodiments of this disclosure.

Figure 4:
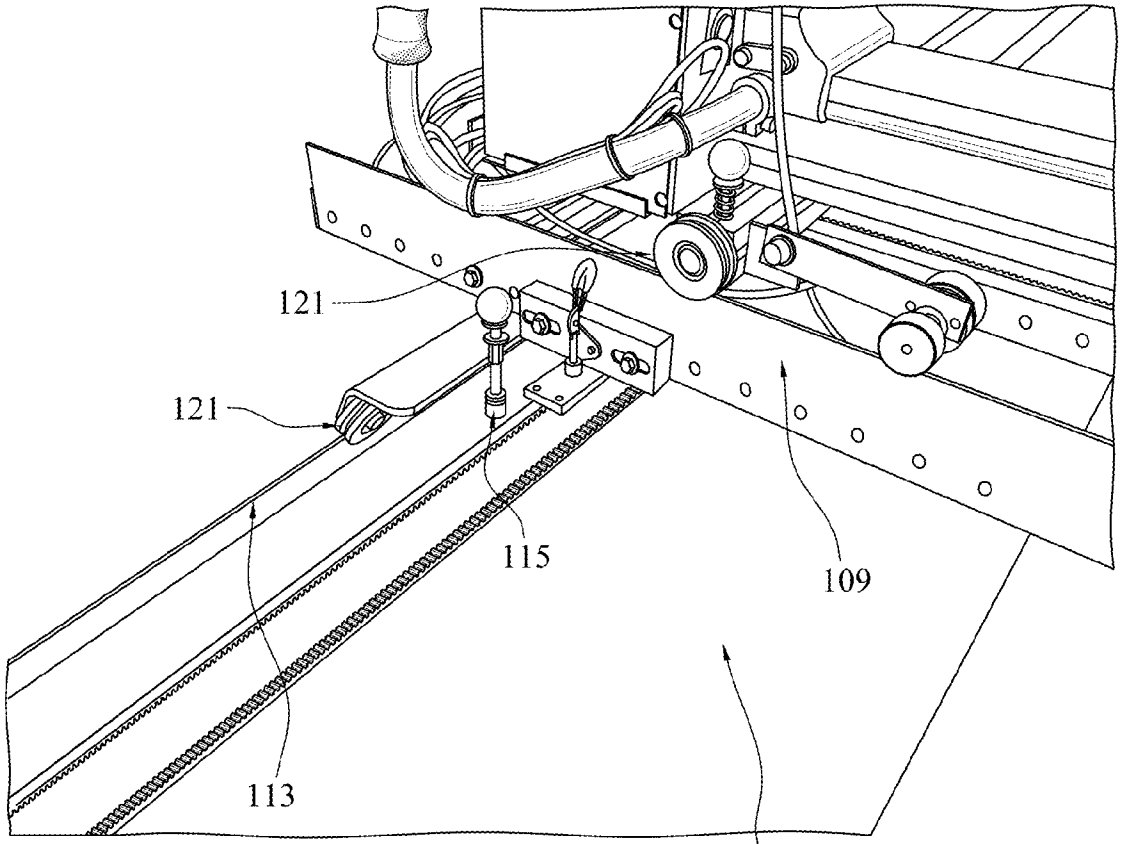

FIG. 4 presents a perspective view of another portion of an exemplary brake system of a quilting machine suitable for use in practicing exemplary embodiments of this disclosure.

FIG. 5 presents a logic flow diagram in accordance with a method, apparatus, and computer-readable medium for performing exemplary embodiments of this disclosure.

Figure 6:
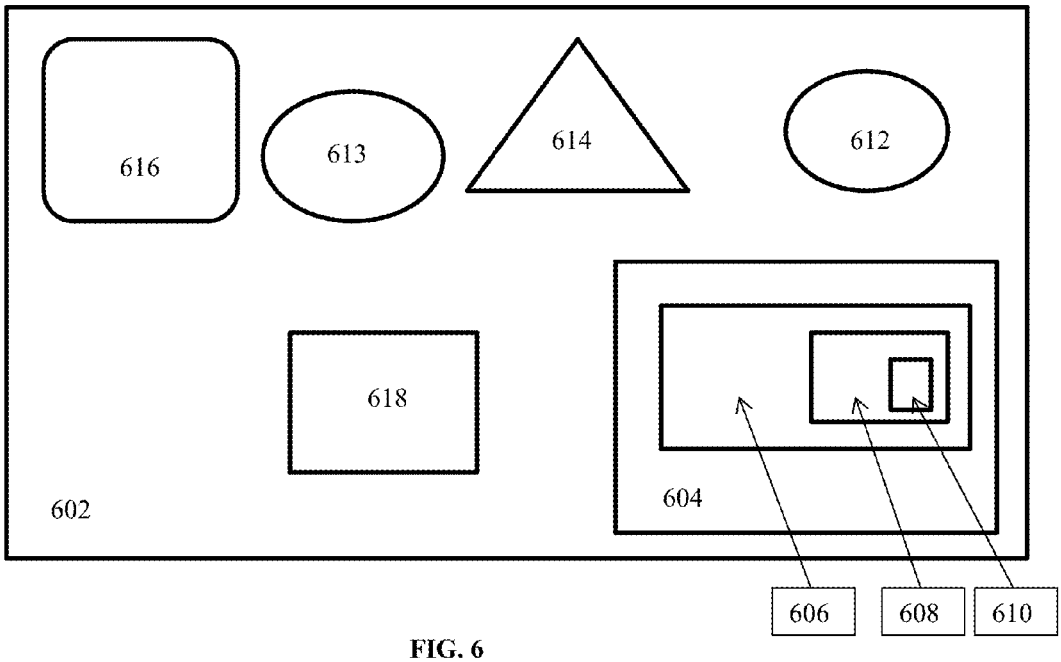

FIG. 6 presents a simplified block diagram of a device suitable for use in practicing exemplary embodiments of this disclosure.

DETAILED DESCRIPTION OF THE INVENTION

In free motion quilting, the user freely determines the location and movement of a sewing head of a quilting machine relative to a work piece. The user moves the sewing head of the quilting machine along X-Y axes over a textile retention area. In computer driven or computer programmed quilting, the user selects the movement of the sewing head, and the computer drives or moves the sewing head based on the user inputs. However, a user often does not always quilt in continuous fluid motions. Rather, a user often has to stop the movement of the sewing head of the quilting machine from moving in one direction and then initiates movement of the sewing head of the quilting machine in another direction.

Additionally, in free motion quilting, a user will sometimes intend to quilt in straight lines either along the X-axis or along the Y-axis of the textile retention area. In this situation, ideally, the quilter will be able to prohibit the sewing head from moving along the unintended axis such that the sewing head only moves along the intended axis of stitching.

Exemplary embodiments of the present disclosure provide a method, apparatus, and computer-readable medium that allow a user to quickly stop movement of the sewing head of the quilting machine, whereas subsequent motion can be in the same or different direction. Exemplary embodiments of the present disclosure also provide a means for a user to move a sewing head of a quilting machine along either of a pair of orthogonal axes without deviating from the desired axis of stitching. Exemplary embodiments of the present disclosure further provide a computer driven or computer programmed quilting machine that can more efficiently stop movement of the sewing head in one direction and then move the sewing head in the same or different direction.

Referring to FIG. 1, a quilting machine 100 for quilting is shown. It should be noted that embodiments of the present disclosure are not limited to the particular configurations of quilting machine 100.

The term quilting machine 100 encompasses any device for stitching or embroidery of a textile 102. The term includes quilting machines 100 for stitching together multiple layers, such as a filler layer between a top and bottom textile layer, as well as an embroidery machine.

Quilting machine 100 includes a main frame 104, a sewing machine 106, supporting frame 108 for supporting or retaining a textile, sewing head 110, a reciprocating needle 112, a motor 114, handles 116, brake handles 118, and brake pads 120 (not shown). The quilting machine 100 further includes a controller 122 operably connected to the sewing head 110 and an encoder 124. The controller 122 includes a computer processor 126 (not shown) and memory 128 (not shown) for storing computer program instructions. The computer program instructions when executed on the computer processor 126 allow for quilting machine 100 to perform the operations described below.

Controller 122 can also include a display and input, such as a touch screen, keyboard, key pad, and/or mouse. The controller 122 can be physically connected to the main frame 104 or the sewing machine 106. Alternatively, the controller 122 can be a stand-alone device, which communicates with the sewing machine 106 and the encoder 124 through a wired or wireless connection.

The term textile 102 encompasses any article of manufacture or fabric made by weaving, felting, knitting, crocheting, compressing natural or synthetic fibers. In one configuration, the textile 102 is a quilt.

Support frame 104 can be any variety of configurations, wherein the frame includes struts or supports for engaging components described herein. The frame can be made of any of a variety of materials or combinations such as metals, plastics, composites or wood.

Although the present disclosure is set forth in terms of a sewing machine 106 that is moved during stitching relative to a portion of the textile 102 (or work piece), it is understood that the textile 102 can be moved relative to a fixed sewing machine. Alternatively, both the sewing machine 106 and the textile 102 can be simultaneously moved.

The sewing machine 106 includes a sewing head 110, typically having a portion above the plane of a work piece retention area and a second portion below the plane of the work piece retention area, thereby providing for passage of a portion of the reciprocating needle 112 through the textile 102 and selectively engaging the passage of a length of thread through the textile 102. Exemplary embodiments of sewing machine 106 are moveable over the work piece retention area.

Support frame 104 provides the work piece retention area that retains the textile 102 or a portion of the textile relative to the main frame 108 and relative to the sewing machine 106. The support frame 104 includes the supply roll assembly 130 and the take up roll assembly 132.

Supply roll assembly 130 retains an initial length of textile wound about a supply roller 134. For systems employing a plurality of layers, such quilting having a liner, a filling and a top layer, there may be three supply rollers in the supply roll assembly 130. One of the supply rollers 134 is set such that a portion of the periphery defines a line in a plane of operation of the sewing machine 106.

Take up roller assembly 132 includes a bed roller 136 having a portion of the periphery generally coplanar with a portion of the periphery of the supply roller 134 and a take up roller 138 for winding the stitched textile 102.

Support frame 104 functions to retain a portion of the textile 102 (work piece) between the line of contact with one of the supply rollers 134 and the bed roller 136, if the take up roller 138 compensates for changing the diameter of the winding. The supply roll assembly 130 and the take up roll assembly 132 create a tension within the textile 102 between the two assemblies, thereby disposing the intermediate textile in a substantially planar orientation and defining a work piece retention area.

Encoder 124 encompasses any optical and mechanical sensors for sensing movement of the sewing machine 106 relative to the frame. The encoder 124 is operable to track and communicate with other elements of quilting machine 100. The encoder 124 is operably coupled to the controller 122 to communicate to controller 122 the data necessary to determine the direction, location, and speed of the sewing head 110 relative to the work piece.

In one exemplary embodiment, as the sewing machine 106 is moved relative to textile 102, the encoder 124 senses the direction and speed of the movement of the sewing machine 106. This movement, encoder 124 communicates to controller 122 and motor 118. Motor 118 controls the up and down speed of reciprocating needle 112. That is, the cycle frequency of the reciprocating needle 112 is driven by the motor 118. In order to provide uniform stitch length, as the velocity and distance moved of sewing machine 106 relative to the work piece is increased so is the speed of motor 118 and the up and down speed of reciprocating needle 112. Likewise, as the velocity and distance moved of sewing machine 106 is decreased so is the speed of motor 118 and the up and down speed of the reciprocating needle 112.

In one exemplary embodiment, sewing machine 106 is attached, sits on, or is placed on a railing system 107 (not shown). Exemplary embodiments of the railing system 107 allow sewing machine 106 to move throughout the extent of the work piece retention area. Exemplary embodiments of railing system 107 provide a set of rails that allow for movement in the x-axis direction and for movement in the y-axis direction along the work piece retention area. Exemplary railing systems 107 may include wheels 121 coupled to sewing machine 106 and rails affixed to main frame 104 that allow for movement of sewing machine 106 with wheels along the rails. In other exemplary embodiments, railing system 107 may simply include a plurality of sliding rails that allow for movement of sewing machine 106 throughout the work piece retention area. In yet another exemplary embodiment, railing system 107 need not include x-axis direction and y-axis direction rails, but simply includes a set of rails that are orthogonal to one another and allow for sewing machine 106 to move throughout the work piece retention area.

Exemplary embodiments of rails of railing system 107 can be substantially planar elongate, strip like members, wherein the wheels 121 of the carriage engage a longitude edge of the rail. Exemplary rails can be flat, such that manufacturing costs are substantially reduced relative to prior bent or multi-thickness rails.

Exemplary embodiments of handles 116 include one or more handles that are affixed or attached to sewing head 110. Handles 116 provide a means for a user to grip and move sewing machine 106 and therefore sewing head 110 in a desired direction through pushing or pulling of the handles 116. Handles 116 are positioned such that a user can grip or hold handles 116 and still be able to view the drop location of reciprocating needle 112 on textile 102 or possibly a display indicating a drop location of reciprocating needle 112 located adjacent to handles 116. In other words, handles 116 do not obstruct the view of the drop location of reciprocating needle 112. As shown in FIG. 1, handles 116 include two handles to be gripped by a user's hands. It should be appreciated that handles 116 may include one or more handles with corresponding grip portions.

FIG. 1 further depicts brake handles 118. Exemplary brake handles 118 are located, and affixed or attached to handles 116 such that a user is able to pull, push, or otherwise activate or release brake handles 118 while holding handles 116. Brake handles 118 are operably connected to brake pads 120 (not shown) such that when brake handles 118 are compressed or activated brake pads 120 are moved to the clamped or braking position. In one exemplary embodiment, one of the brake handles 118 is operably coupled to a first brake pad 120 affixed to the sewing head relative to a x-axis rail and able to selectively engage the x-axis rail, the first brake operable between an open position and a closed position. The open position allowing movement of the sewing head along the x-axis rail, the closed position substantially preventing movement of the sewing head along the x-axis rail. The other brake handle 118 is operably coupled to a second brake pad 120 affixed to the sewing head relative to a y-axis rail and able to selectively engage the y-axis rail, the second brake pad 120 operable between an open position and a closed position. The open position allowing movement of the sewing head along the y-axis rail, the closed position substantially preventing movement of the sewing head along the y-axis rail. In one configuration, the brake pads 120 are coupled to a caliper.

Brake pads 120 can be affixed to sewing machine 106 such that they are operable on the rails of railing system 107. In an alternative embodiment, brake pads 120 can be affixed to sewing machine 106 such that they are operable on the wheels that are also affixed to sewing machine 106 and interact with the rails of railing system 107.

When brake handles 118 are released or not activated, brake pads 120 are moved to the opened or released position. Exemplary embodiments of brake handles 118 provide that each brake handle 118 is operably connected to a single brake pad 120. For example, the left brake handle 118 may be operably connected to brake pad 120 located on the x-axis rail of railing system 107, and the right brake handle 118 is operably connected to a brake pad 120 located on the y-axis rail of railing system 107. In this configuration, the user is able to select which axial direction (i.e., x-axis or y-axis) the user desires to allow or prevent movement of sewing machine 106. In another exemplary embodiment, each brake handle 118 is operably connected to each brake pad 120 such that operation of either brake handle 118 either individually or together activates both brake pads 120 to the clamping position and thus prevents movement of sewing machine 106 in any direction relative to the work piece.

Exemplary embodiments of brake handles 118 include mechanical means such as a lever coupled to a wire or wiring which when pulled or activated by a user causes brake pads 120 to move to the clamped position. In another exemplary embodiment, brake handles 118 include electronic or touch sensitive/panel means which through electrical wiring or computer signals activate brake pads 120 to the clamped or open position. Brake handles 118 can be operably connected to the brakes, such as brake pads 120 through wired or wireless means.

In a further exemplary embodiment, quilting machine 100 through controller 122 includes a processor and a memory storing computer program instructions, which when executed by the processor cause the processor to stitch in a predetermined manner and activates brake pads 120 at certain instances during the stitching process. For example, a user may control the stitching and movement of sewing machine 106 through the use of a preprogrammed stitching pattern stored as computer program instructions in the memory. When the program is selected, sewing machine 106 will stitch the preprogrammed stitching pattern and will at select moments during the stitching activate and release brake pads 120 in accordance to the required movement of the sewing machine 106. In another example, a user may control the stitching and movement of sewing machine 106 through the use of a remote control. In this embodiment, the user may selectively activate brake pads 120 through a remote control that operates sewing machine 106, reciprocating needle 112 and the movement of sewing machine 106 through the work piece retention area.

Referring to FIG. 2, shown is a perspective view of an exemplary brake system of a quilting machine suitable for use in practicing exemplary embodiments of this disclosure. FIG. 2 depicts a sewing machine 106, sewing head 110, handles 116, wire 119, and brake handles 118. As illustrated in FIG. 2, handles 116 are coupled to sewing head 110 of sewing machine 106. Further, brake handles 118 are adjacent or proximate to the handles 116 such that a user can manipulate the brakes while viewing stitching or the drop location of reciprocating needle 112 by the sewing head 110 in the work piece retention area. Handles 116 may include a cushion grip or other grip known in the art to allow a user to more comfortably grip handles 116. Affixed to handles 116 are brake handles 118 for stopping or braking the movement of sewing machine 106 over the work piece retention area. As depicted, brake handles 118 are in the open, released, or non-braking position. Exemplary embodiments of brake handles 118 provide that brake handles 118 when not in use are maintained in the open, released, or non-braking position. In other exemplary embodiments brake handles 118, when not in use, are maintained in the closed or braking position. Brake handles 118, as shown in FIG. 2, may be moved to the closed or braking position by a user by pulling brake handles 118 toward handles 116.

FIG. 2 also depicts wire 119, which is coupled to brake handle 118. Wire 119 is also coupled to brake pads 120. Wire 119 is coupled such that movement of brake handles 118 from the open/non-braking position to the closed/braking position moves brake pads 120 from the open/non-braking position to the closed/clamping/braking position. Conversely, wire 119 is also coupled such that movement of brake handles 118 from the closed/braking position to the open/non-braking position moves brake pads from the closed/clamping/braking position to the open/non-braking position. Exemplary embodiments of wire 119 provide for a mechanical or electrical wires for mechanically or electrically communicating the movement of brake handles 118.

FIG. 1 further illustrates lock 140 located on brake handles 118. Exemplary embodiments of lock 140 provide a means for selectively locking brake handles 118 in the closed/clamping/braking position. For example, a user may compress brake handles 118 or one of the two shown brake handles 118 into the closed/clamping/braking position and then desire to maintain brake handles 118 in the closed/clamping/braking position. Lock 140 may then be pushed, turned, or activated into the locked position such that brake handles 118 remain in the closed/clamping/braking position without the user having to manually compress brake handles 118. Lock 140 will then maintain brake handles 118 in the closed/clamping/braking position until the user disengages lock 140 into the unlocked position. Exemplary embodiments of lock 140 can remain in the locked or unlocked position without user interaction.

Referring to FIG. 3, presented is a close up view of a portion of an exemplary brake system of a quilting machine suitable for use in practicing exemplary embodiments of this disclosure. Shown in FIG. 3 is an exemplary rail 109 of railing system 107, brake pad 120, wheel 121, and clamp 123. As is evident, wheel 121 is affixed to sewing machine 106 such that wheel 121 can rotate freely on rail 109. Wheel 121 sits on and rotates on rail 109 such that wheel 121 can move along the extent of rail 109, which provides for movement throughout the work piece retention area. Rail 109 as shown in FIG. 3 extends along the y-axis of the work piece retention area. Exemplary embodiments of railing system 107 also include at least another rail 111 (not shown) parallel to rail 109 along the y-axis of the work piece retention area located on the opposite side of quilting machine 106 from rail 109. Exemplary embodiments of railing system 107 further include one or more rails 113 (not shown) located along the x-axis of the work piece retention area. Exemplary embodiments of quilting machine 106 also include wheels 121, clamps 123, and brake pads 120 operably located on or along rails 109 and one or more rails 113 such that quilting machine 106 can move throughout the work piece retention area in the x-axis direction or y-axis direction.

In the exemplary embodiment shown in FIG. 3, brake pad 120, when activated by a user, can operably compress, clamp, or brake on rail 109 thereby creating friction and thus slowing or stopping movement of quilting machine 106. In other exemplary embodiments brake pad 120 is located adjacent to wheel 121 and operable on wheel 121, such that brake pad 120 compresses, clamps, or brakes on wheel 121. In this exemplary embodiment, brake pad 120 slows or stops wheel 121 from rotating and thus slows or stops movement of quilting machine 106. Exemplary embodiments of brake pad 120 are able to be selectively activated, compressed, or braked to slow or stop movement of quilting machine 106 along railing system 107. In another exemplary embodiment, quilting machine 106 only includes a single brake pad 120 for one of the rails extending in the x-axis direction and a single brake pad 120 for one of the rails extending in the y-axis direction.

Clamp 123 is affixed to brake pad 120 and provides a user of quilting machine 106 with the ability to manually lock brake pad 120 in the clamped or braking position. As shown in FIG. 3, clamp 123 is in the unlocked position, but clamp 123 can be rotated, moved or activated such that brake pad 120 is maintained in the compressed, clamped, or braking position. Clamp 123 is able to maintain brake pad 120 in the braking position, thereby preventing movement of quilting machine 106 along rail 109 until the user puts clamp 123 into the unlocked, unclamped, or non-braking position. Exemplary embodiments of the present disclosure provide for one, more than one, or every brake pad 120 to include a clamp 123 such that a user can select specific brake pads 120 to place in the locked, compressed, or braking position with clamp 123.

Exemplary embodiments of clamp 123 include manual clamps as depicted in FIG. 3 and electronic or robotic mechanisms that allow clamp 123 to be selectively maintained in the braking position. Exemplary embodiments of clamp 123 allow a user to selectively place and maintain brake pads 120 in the locked, compressed, or braking position until the user desires to move clamp 123 into the unlocked or non-braking position.

Referring to FIG. 4, presented is a perspective view of another portion of an exemplary brake system of a quilting machine suitable for use in practicing exemplary embodiments of this disclosure. Shown in FIG. 4 are rail 109, rail 113, compressor 115, two wheels 121, and surface 117. Rail 113 extends along the x-axis through the work piece retention area and provides a means for quilting machine 106 to move in along the x-axis through the use of wheel 121. Exemplary embodiments of the present disclosure include a brake pad 120 (not shown) affixed to quilting machine 106 and operable on rail 113 to slow or stop movement of quilting machine 106 along rail 113.

Compressor 115 provides another alternative braking means for quilting machine 106. Exemplary embodiments of compressor 115 can selectively compress on surface 117 to substantially prevent quilting machine 106 from moving. Exemplary embodiments of compressor 115 include a screw mechanism that allows a user to turn compressor 115 in a clockwise or counterclockwise direction to move compressor 115 towards or away from surface 117 and is able to maintain its position. Exemplary embodiments of compressor 115 can thus either manually or electronically create friction with surface 117 such that movement of quilting machine in the x-axis direction is substantially prevented. It should be appreciated that while compressor 115 as depicted in FIG. 4 includes a screw mechanism to move it into the compressed position, exemplary embodiments of compressor 115 includes any type of mechanism that has the same functionality including springs and levers.

Referring to FIG. 5, presented is an exemplary logic flow diagram in accordance with a method, apparatus, and computer-readable medium for performing exemplary embodiments of this disclosure. Block 502 presents moving a sewing head in a first coordinate direction along a first coordinate rail and a second coordinate direction along a second coordinate rail, the first coordinate direction and the second coordinate direction being perpendicular to one another; and braking, by a first brake and a second brake, a movement of the sewing head, the first brake affixed to the sewing head relative to the first coordinate rail and able to selectively engage the first coordinate rail, the first brake operable between an open position and a closed position, the open position allowing movement of the sewing head along the first coordinate rail, the closed position substantially preventing movement of the sewing head along the first coordinate rail, the second brake affixed to the sewing head relative to the second coordinate rail and able to selectively engage the second coordinate rail, the second brake operable between an open position and a closed position, the open position allowing movement of the sewing head along the second coordinate rail, the closed position substantially preventing movement of the sewing head along the second coordinate rail. Then block 504 specifies wherein the first brake further comprises a first lock, the first lock operable between a locked position and an unlocked position, the locked position maintaining the first brake in a closed position, and wherein the second brake further comprises a second lock, the second lock operable between a locked position and an unlocked position, the locked position maintaining the second brake in the close position.

Some of the non-limiting implementations detailed above are also summarized at FIG. 5 following block 504. Block 506 relates to wherein the first lock comprises a manual lever, and wherein the second lock comprises a manual lever. Block 508 then further specifies wherein the sewing head further comprises a first handle and a second handle, the first handle comprising a first lever and a first connector, the first connector coupled to the first brake, the second handle comprising a second lever and a second connector, the second connector coupled to the second brake, the first handle and the second handle coupled to the sewing head and able to assist movement of the sewing head along the first coordinate rail and the second coordinate rail, the first lever and the second lever moveable between an open position and a clamping position, the open position of the first lever through the first connector corresponds to the open position of the first brake, the clamping position of the first lever through the first connector corresponds to the closed position of the first brake, the open position of the second lever through the second connector corresponds to the open position of the second brake, the clamping position of the second lever through the second connector corresponds to the closed position of the second brake.

Block 510 then specifies wherein the first handle further comprises a first handle lock for locking the first lever in the clamped position, and the second handle further comprises a second handle lock for locking the second lever in the clamped position. Block 512 then relates to wherein the first coordinate rail and the second coordinate rail includes a flange.

The logic diagram of FIG. 5 may be considered to illustrate the operation of a method, a result of execution of computer program instructions stored in a computer-readable medium. The logic diagram of FIG. 5 may also be considered a specific manner in which components of the device are configured to cause that device to operate, whether such a device is a clock, biometric clock, electronic device, laptop, tablet, desktop or other device, or one or more components thereof. The various blocks shown in FIG. 5 may also be considered as a plurality of coupled circuit elements constructed to carry out the associated function(s), or specific result of strings of computer program instructions or code stored in memory.

Various embodiments of the computer-readable medium include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EEPROM) and the like. Various embodiments of the processor include but are not limited to general purpose computers, special purpose computers, microprocessors digital signal processors and multi-core processors.

Reference is now made to FIG. 6, which illustrates a simplified block diagram of the various elements of a device suitable for use in practicing the exemplary embodiments of this disclosure. In FIG. 6, device 602 is adapted for stitching a work piece and selectively braking. Device 602 may be any quilting or sewing machine or other device suitable for stitching together two or more pieces of fabric.

Device 602 includes processing means such as a controller 604 which includes at least one data processor 606, storing means such as at least one computer-readable memory 608 storing at least one computer program 610. Controller 604, the at least one data processor 606, and the at least one computer-readable memory 608 with the at least one computer program 610 may provide a mechanism to interpret and determine the movement of a work piece and when to activate brakes 612. Device 602 further includes at least one sensor 613 for sensing the movement of device 602 or the work piece. Sensor 613 is operably connected to controller 604 such that sensor 613 is able to transmit sensor information to controller 604 and to data processor 606. Device 602 also includes brakes 612 for braking or stopping movement of device 602. Exemplary embodiments of the present disclosure provide that brakes 612 are operably connected to controller 604 and/or activator 614 for selectively activating brakes 612. Device 602 further includes motor 616 operably connected to controller 604 and reciprocating needle 618. Reciprocating needle 618 is operably connected to controller 604. The cycle frequency of reciprocating needle 618 is controlled by motor 616, which is in turn determined by controller 604.

Device 602 also includes encoder 620 to encode the sensed movement information determined by the data processor 606 such that it can be read by motor 616. Encoder is operably connected to controller 604, data processor 606, and motor 616. Device 602 includes an operational on/off switch 622 for selectively operating controller 604, motor 616, reciprocating needle 618, and encoder 620. In some exemplary embodiments, on/off switch 620 is a foot pedal that can be pressed to operate device 602. In other exemplary embodiments, on/off switch 620 is a physical switch located on device 602 that can be operated by hand.

The at least one computer program 610 in device 602 in exemplary embodiments is a set of program instructions that, when executed by the associated data processor 606, enable device 602 to operate in accordance with exemplary embodiments of this disclosure, as detailed above. In these regards, the exemplary embodiments of this disclosure may be implemented at least in part by a computer software stored in computer-readable memory 608, which is executable by the data processor 606. Devices implementing these aspects of the disclosure need not be the entire device as depicted in FIG. 6 or may be one or more components of same, such as the above described tangibly stored software, hardware, and data processor.

It is to be understood that any feature described in relation to any one embodiment may be used alone, or in combination with other features described, and may also be used alone, or in combination with one or more features of any other of the embodiments, or any combination of any other of the embodiments. The presently disclosed embodiments are therefore considered in all respects to be illustrative and restrictive. Furthermore, equivalents and modifications not described above may also be employed without departing from the scope of this disclosure, which is defined in the accompanying claims.

The invention claimed is:

1. An apparatus for quilting, the apparatus comprising:

a plurality of rails, the plurality of rails comprising an x-axis rail and a y-axis rail;

a sewing head, the sewing head moveable along the plurality of rails;

a first brake, the first brake affixed to the sewing head relative to the x-axis rail and able to selectively engage the x-axis rail, the first brake operable between an open position and a closed position, the open position allowing movement of the sewing head along the x-axis rail, the closed position substantially preventing movement of the sewing head along the x-axis rail; and a second brake, the second brake affixed to the sewing head relative to the y-axis rail and able to selectively engage the y-axis rail, the second brake operable between an open position and a closed position, the open position allowing movement of the sewing head along the y-axis rail, the closed position substantially preventing movement of the sewing head along the y-axis rail.

2. The apparatus according to claim 1, wherein the first brake further comprises a first lock, the first lock operable between a locked position and an unlocked position, the locked position maintaining the first brake in a closed position, and wherein the second brake further comprises a second lock, the second lock operable between a locked position and an unlocked position, the locked position maintaining the second brake in the close position.

3. The apparatus according to claim 2, wherein the first lock comprises a manual lever, and wherein the second lock comprises a manual lever.

4. The apparatus according to claim 3, the apparatus further comprising a first handle and a second handle, the first handle comprising a first lever and a first connector, the first connector coupled to the first brake, the second handle comprising a second lever and a second connector, the second connector coupled to the second brake, the first handle and the second handle coupled to the sewing head and able to assist movement of the sewing head along the plurality of rails, the first lever and the second lever moveable between an open position and a clamping position, the open position of the first lever through the first connector corresponds to the open position of the first brake, the clamping position of the first lever through the first connector corresponds to the closed position of the first brake, the open position of the second lever through the second connector corresponds to the open position of the second brake, the clamping position of the second lever through the second connector corresponds to the closed position of the second brake.

5. The apparatus according to claim 4, wherein the first handle further comprises a first handle lock for locking the first lever in the clamped position, and the second handle further comprises a second handle lock for locking the second lever in the clamped position.

6. The apparatus according to claim 5, wherein the plurality of rails include a flange.

7. The apparatus according to claim 3, the apparatus further comprising a processor, a memory comprising computer program instructions, and a user interface, the processor, the memory, and the user interface operably coupled to the first brake and the second brake to selectively engage the first brake and the second brake to the open position and the closed position.

8. A method for quilting, the method comprising:

moving a sewing head in a first coordinate direction along a first coordinate rail and a second coordinate direction along a second coordinate rail, the first coordinate direction and the second coordinate direction being perpendicular to one another; and braking, by a first brake and a second brake, a movement of the sewing head, the first brake affixed to the sewing head relative to the first coordinate rail and able to selectively engage the first coordinate rail, the first brake operable between an open position and a closed position, the open position allowing movement of the sewing head along the first coordinate rail, the closed position substantially preventing movement of the sewing head along the first coordinate rail, the second brake affixed to the sewing head relative to the second coordinate rail and able to selectively engage the second coordinate rail, the second brake operable between an open position and a closed position, the open position allowing movement of the sewing head along the second coordinate rail, the closed position substantially preventing movement of the sewing head along the second coordinate rail.

9. The method according to claim 8, wherein the first brake further comprises a first lock, the first lock operable between a locked position and an unlocked position, the locked position maintaining the first brake in a closed position, and wherein the second brake further comprises a second lock, the second lock operable between a locked position and an unlocked position, the locked position maintaining the second brake in the close position.

10. The method according to claim 9, wherein the first lock comprises a manual lever, and wherein the second lock comprises a manual lever.

11. The method according to claim 10, wherein the sewing head further comprises a first handle and a second handle, the first handle comprising a first lever and a first connector, the first connector coupled to the first brake, the second handle comprising a second lever and a second connector, the second connector coupled to the second brake, the first handle and the second handle coupled to the sewing head and able to assist movement of the sewing head along the first coordinate rail and the second coordinate rail, the first lever and the second lever moveable between an open position and a clamping position, the open position of the first lever through the first connector corresponds to the open position of the first brake, the clamping position of the first lever through the first connector corresponds to the closed position of the first brake, the open position of the second lever through the second connector corresponds to the open position of the second brake, the clamping position of the second lever through the second connector corresponds to the closed position of the second brake.

12. The method according to claim 11, wherein the first handle further comprises a first handle lock for locking the first lever in the clamped position, and the second handle further comprises a second handle lock for locking the second lever in the clamped position.

13. The method according to claim 12, wherein the first coordinate rail and the second coordinate rail includes a flange.

14. The method according to claim 10, wherein the sewing head is operably coupled to a processor, a memory comprising computer program instructions, and a user interface, the processor, the memory, and the user interface operably coupled to the first brake and the second brake to selectively engage the first brake and the second brake to the open position and the closed position.

15. A non-transitory computer-readable medium tangibly comprising computer program instructions, which when executed by a processor, causes the processor to at least:

move a sewing head in a first coordinate direction along a first coordinate rail and a second coordinate direction along a second coordinate rail, the first coordinate direction and the second coordinate direction being perpendicular to one another; and brake, by a first brake and a second brake, a movement of the sewing head, the first brake affixed to the sewing head relative to the first coordinate rail and able to selectively engage the first coordinate rail, the first brake operable between an open position and a closed position, the open position allowing movement of the sewing head along the first coordinate rail, the closed position substantially preventing movement of the sewing head along the first coordinate rail, the second brake affixed to the sewing head relative to the second coordinate rail and able to selectively engage the second coordinate rail, the second brake operable between an open position and a closed position, the open position allowing movement of the sewing head along the second coordinate rail, the closed position substantially preventing movement of the sewing head along the second coordinate rail.

16. The non-transitory computer-readable medium according to claim 15, wherein the first brake further comprises a first lock, the first lock operable between a locked position and an unlocked position, the locked position maintaining the first brake in a closed position, and wherein the second brake further comprises a second lock, the second lock operable between a locked position and an unlocked position, the locked position maintaining the second brake in the close position.

17. The non-transitory computer-readable medium according to claim 16, wherein the first lock comprises a manual lever, and wherein the second lock comprises a manual lever.

18. The non-transitory computer-readable medium according to claim 17, wherein the sewing head further comprises a first handle and a second handle, the first handle comprising a first lever and a first connector, the first connector coupled to the first brake, the second handle comprising a second lever and a second connector, the second connector coupled to the second brake, the first handle and the second handle coupled to the sewing head and able to assist movement of the sewing head along the first coordinate rail and the second coordinate rail, the first lever and the second lever moveable between an open position and a clamping position, the open position of the first lever through the first connector corresponds to the open position of the first brake, the clamping position of the first lever through the first connector corresponds to the closed position of the first brake, the open position of the second lever through the second connector corresponds to the open position of the second brake, the clamping position of the second lever through the second connector corresponds to the closed position of the second brake.

19. The non-transitory computer-readable medium according to claim 18, wherein the first handle further comprises a first handle lock for locking the first lever in the clamped position, and the second handle further comprises a second handle lock for locking the second lever in the clamped position.

20. The non-transitory computer-readable medium according to claim 19, wherein the first coordinate rail and the second coordinate rail includes a flange.

* * * * *